United States Patent [19]

Roberts et al.

[11] Patent Number: 4,986,286

[45] Date of Patent: Jan. 22, 1991

[54] TOBACCO TREATMENT PROCESS

[75] Inventors: Donald L. Roberts, Winston-Salem, N.C.; Carmen C. Fernandez, Palmerston North, New Zealand

[73] Assignee: R. J. Reynolds Tobacco Company, Winston-Salem, N.C.

[21] Appl. No.: 346,042

[22] Filed: May 2, 1989

[51] Int. Cl.[5] ..... A24B 15/18

[52] U.S. Cl. ..... 131/290; 131/275; 131/297; 131/303; 131/309

[58] Field of Search ..... 131/290, 297, 298, 299, 131/300, 301, 302, 303, 304, 305, 306, 309, 275

[56] References Cited

U.S. PATENT DOCUMENTS

| | | |
|---|---|---|
| 3,174,485 | 3/1965 | Griffith et al. . |
| 3,316,919 | 5/1967 | Green et al. . |
| 3,398,754 | 1/1969 | Tughan . |
| 3,424,171 | 1/1969 | Rooker . |
| 3,803,004 | 7/1974 | Egri . |
| 3,894,543 | 7/1975 | Anderson et al. . |
| 4,150,677 | 4/1979 | Osborne, Jr. et al. . |
| 4,244,381 | 1/1981 | Lendvay . |
| 4,256,123 | 3/1981 | Lendvay et al. . |
| 4,497,330 | 2/1985 | Banyasz et al. . |
| 4,506,682 | 3/1985 | Muller . |
| 4,596,259 | 6/1986 | White et al. . |
| 4,607,646 | 8/1986 | Lilly, Jr. et al. . |
| 4,714,082 | 12/1987 | Banerjee et al. . |
| 4,744,375 | 5/1988 | Denier et al. . |
| 4,756,318 | 7/1988 | Clearman et al. . |
| 4,793,365 | 12/1988 | Sensabaugh, Jr. et al. . |
| 4,819,668 | 4/1989 | Shelar et al. . |
| 4,827,949 | 5/1989 | Sunas . |

FOREIGN PATENT DOCUMENTS

| | | |
|---|---|---|
| 72/3935 | 6/1972 | South Africa . |

OTHER PUBLICATIONS

*J. Agr. Food Chem.*, Roeraade et al., vol. 20, No. 5, p. 1035 (1972).

*18th Tob. Chem. Res. Conf.*, Johnson et al. (1964).

*Primary Examiner*—Vincent Millin

[57] ABSTRACT

Flavorful tobacco substances are provided by extracting tobacco with water, spray drying the resulting liquid tobacco extract, contacting the spray dried extract with a glycerine carrier, and subjecting the extract and carrier to a temperature above 150° C. for a period of time sufficient to eliminate the harsh or "green" taste provided by the extract. The flavorful tobacco substances are useful as forms of tobacco in smoking product manufacture.

20 Claims, 6 Drawing Sheets

TOBACCO TREATMENT PROCESS

BACKGROUND OF THE INVENTION

The present invention relates to flavorful forms of tobacco for cigarettes and other types of smoking articles and, in particular, to processes for providing such flavorful forms of tobacco.

Cigarettes, cigars and pipes are popular forms of smoking articles which use tobacco in various forms. Many types of smoking products and improved smoking articles have been proposed through the years as improvements upon, or as alternatives to, the popular types of smoking articles. Recently, U.S. Pat. Nos. 4,708,151 to Shelar; 4,771,795 to White et al.; 4,714,082 to Banerjee et al.; 4,756,318 to Clearman et al.; and 4,793,365 to Sensabaugh, Jr. et al.; and European Patent Publication Nos. 212,234 and 277,519 propose cigarettes and pipes which comprise a fuel element, an aerosol generating means physically separate from the fuel element, and a separate mouthend piece. Such types of smoking articles provide natural tobacco flavors to the smoker thereof by heating, rather than burning, tobacco in various forms. As natural tobacco flavors are important components of smoking articles in order that such smoking articles can provide adequate tobacco taste and aroma, improved processes for providing natural tobacco flavor substances and flavorful forms of tobacco clearly are desirable.

U.S. Pat. No. 3,316,919 to Green proposes the preparation of tobacco extracts for use in cigarettes. In particular, tobacco is extracted with cold water, the liquid extract is freeze dried and ground to a powder form, and the powder is dusted onto tobacco filler for cigarette manufacture.

U.S. Pat. No. 3,398,754 to Tughan proposes extracting tobacco with water and spray drying the liquid extract to provide a tobacco extract in powder form. The spray dried tobacco extract is useful in the manufacture of smoking products.

U.S. Pat. No. 3,424,171 to Rooker proposes a process for the production of a smokable product having a tobacco taste. The proposed process involves heating tobacco to a temperature of about 175° C. to about 200° C. to release aromatic components from the tobacco. The aromatic components so released then are trapped on absorbent charcoal, and then are removed from the charcoal by solvent extraction. The mixture of tobacco aromatic components and solvent then is applied to vegetable matter to provide a smokable product.

U.S. Pat. No. 4,506,682 to Mueller proposes the preparation of tobacco aroma oils. Tobacco is extracted using a hydrocarbon solvent and the extracted tobacco components are deposited onto a substrate. The extract carried by the substrate then is subjected to an extraction process using a solvent in a supercritical state.

It would be highly desirable to provide a process for efficiently and effectively producing flavorful forms of tobacco which exhibit a tobacco smoke-like flavor and character.

SUMMARY OF THE INVENTION

The present invention relates to a process for providing flavorful natural tobacco substances which are useful forms of tobacco for various types of cigarettes and other smoking articles. In particular, a tobacco extract is subjected to moderately high temperature treatment for a period of time sufficient to alter the flavor and aroma characteristics of the extract. Normally, the tobacco extract is exposed to a temperature sufficiently high and for a period of time sufficiently long so as to provide an extract which does not exhibit a "green" or harsh flavor. However, it is preferable that the tobacco extract not be exposed to such a high temperature for a sufficiently long period of time so as to provide an extract which exhibits an overly bitter, highly metallic or woody flavor.

The tobacco extract can be combined with certain materials and/or carried by a substrate during the time that it undergoes the moderately high temperature treatment. Thus, for purposes of this invention, it is convenient to refer to the heat treatment of a tobacco composition. For purposes of this invention, a tobacco composition can include (i) a tobacco extract, (ii) a tobacco extract and a liquid carrier for the extract, (iii) a tobacco extract and a substrate which carries the extract, or (iv) a tobacco extract, a liquid material, and a substrate which carries the extract and liquid material.

The present invention preferably relates to a process for providing natural tobacco substances involving subjecting a tobacco composition to exposure to a temperature above about 150° C. and a temperature exposure index in the range of about 200 to about 600. For purposes of this invention, the temperature exposure index values are reported in units of min.°C./g. In particular, the term "temperature exposure index" relates to the temperature in degrees Celsius to which the tobacco composition is exposed multiplied by the time in minutes that the tobacco composition is exposed to that temperature divided by the mass in grams of the tobacco composition which is exposed to the temperature.

The flavorful tobacco substances so provided are useful as forms of tobacco for smoking products. For example, such flavorful tobacco substances are useful as casing or top dressing components for tobacco laminae and cut filler, as well as for other smokable materials. Alternatively, such flavorful tobacco substances are useful as one form of tobacco employed in those types of smoking articles described in U.S. Pat. Nos. 4,708,151 to Shelar; 4,771,795 to White et al.; 4,714,082 to Banerjee et al.; 4,756,318 to Clearman et al.; and 4,793,365 to Sensabaugh et al.; as well as European Patent Publication Nos. 212,234 and 277,519.

DETAILED DESCRIPTION OF THE PREFERRED EMBODIMENTS

Figure 1:
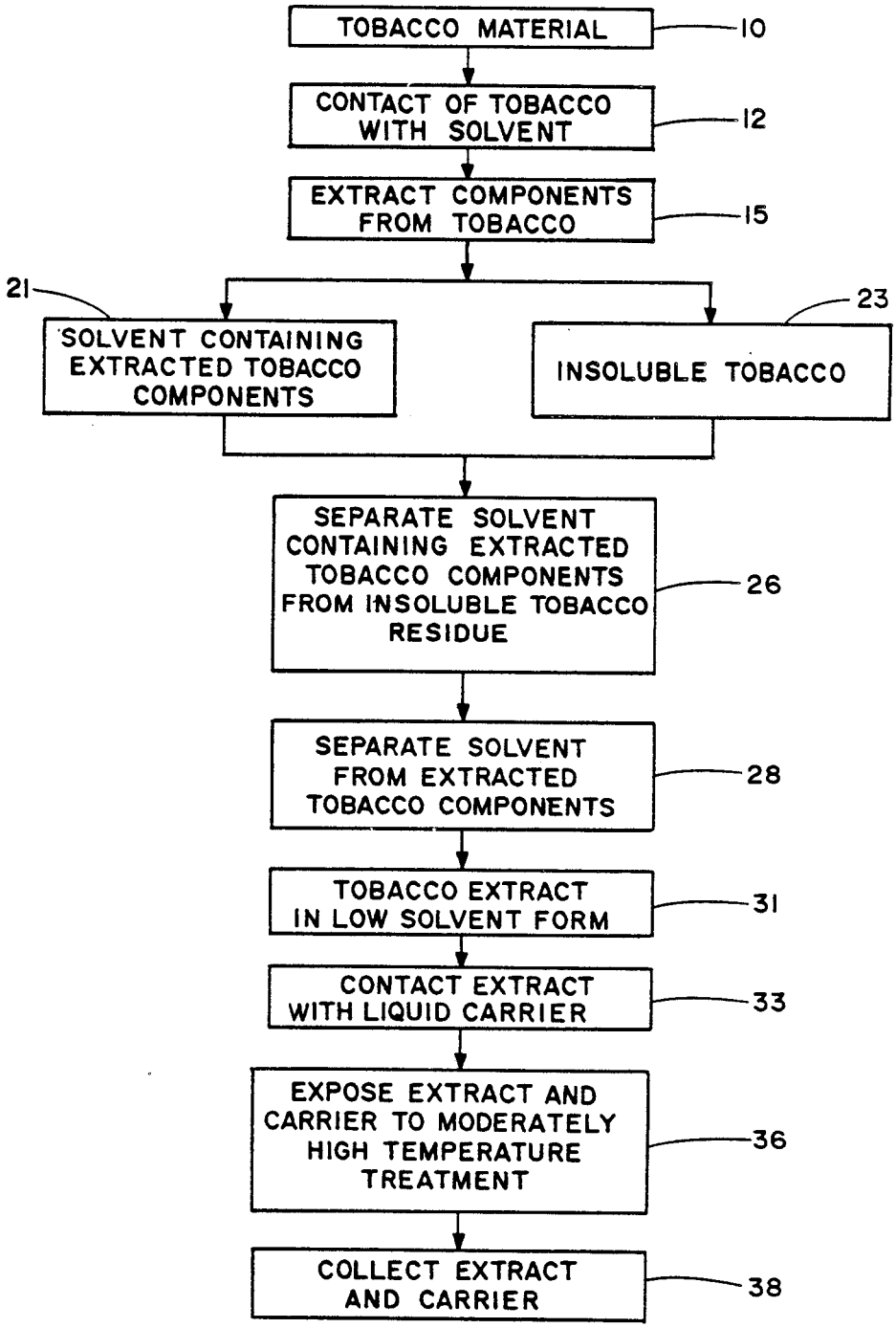
FIGS. 1 through 5 are schematic diagrams of process steps representative of embodiments of this invention.

Referring to FIG. 1, tobacco material 10 is contacted with a solvent 12 such as water. As such, components 15 are extracted from the tobacco material 10 yielding solvent containing extracted tobacco components 21 and an insoluble tobacco residue 23. The solvent containing the extracted tobacco components is separated 26 from the insoluble residue using centrifugation techniques, or the like. The extracted tobacco components are separated from the solvent by distillation techniques followed by spray drying techniques 28, or the like. The resulting isolated extract 31 in low solvent form is contacted with a liquid carrier 33 such as glycerine, or the like. The extract and carrier are subjected to a moderately high temperature treatment 36 for a controlled period of time sufficient to provide desirable flavor characteristics to the extract. The extract and carrier then are collected 38 for later use in the manufacture of cigarettes and other smoking articles.

Figure 2:
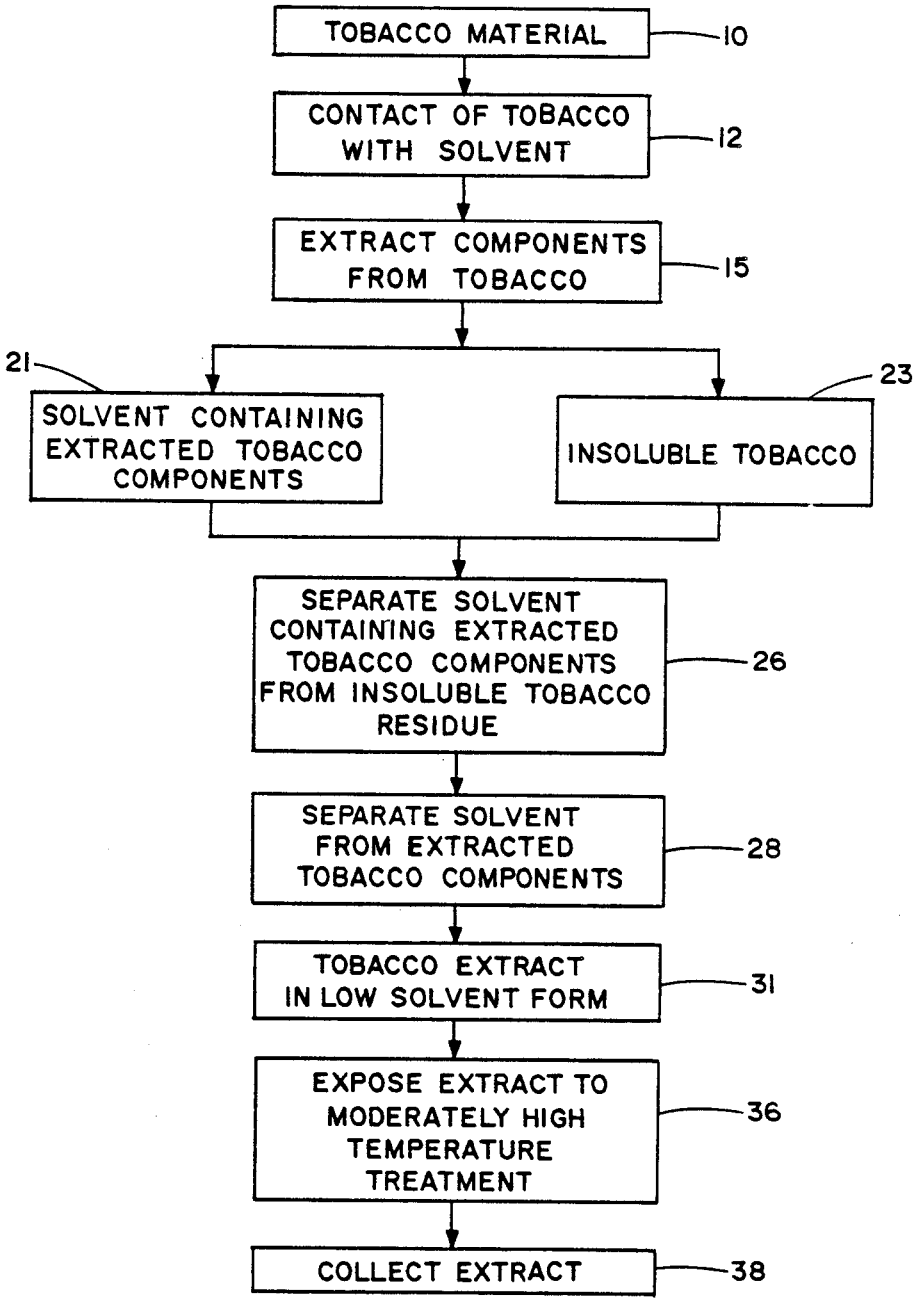

Referring to FIG. 2, tobacco material 10 is extracted using a solvent 12 to provide an isolated extract 31 in low solvent form, in a manner as described with reference to FIG. 1. The tobacco extract 31 in low solvent form is subjected to a moderately high temperature treatment 36 for a controlled period of time sufficient to provide desirable flavor characteristics to the extract. The extract then can be contacted with a carrier 41 such as glycerine, propylene glycol, water, ethanol, or the like, and used in the manufacture of smoking articles.

Figure 3:
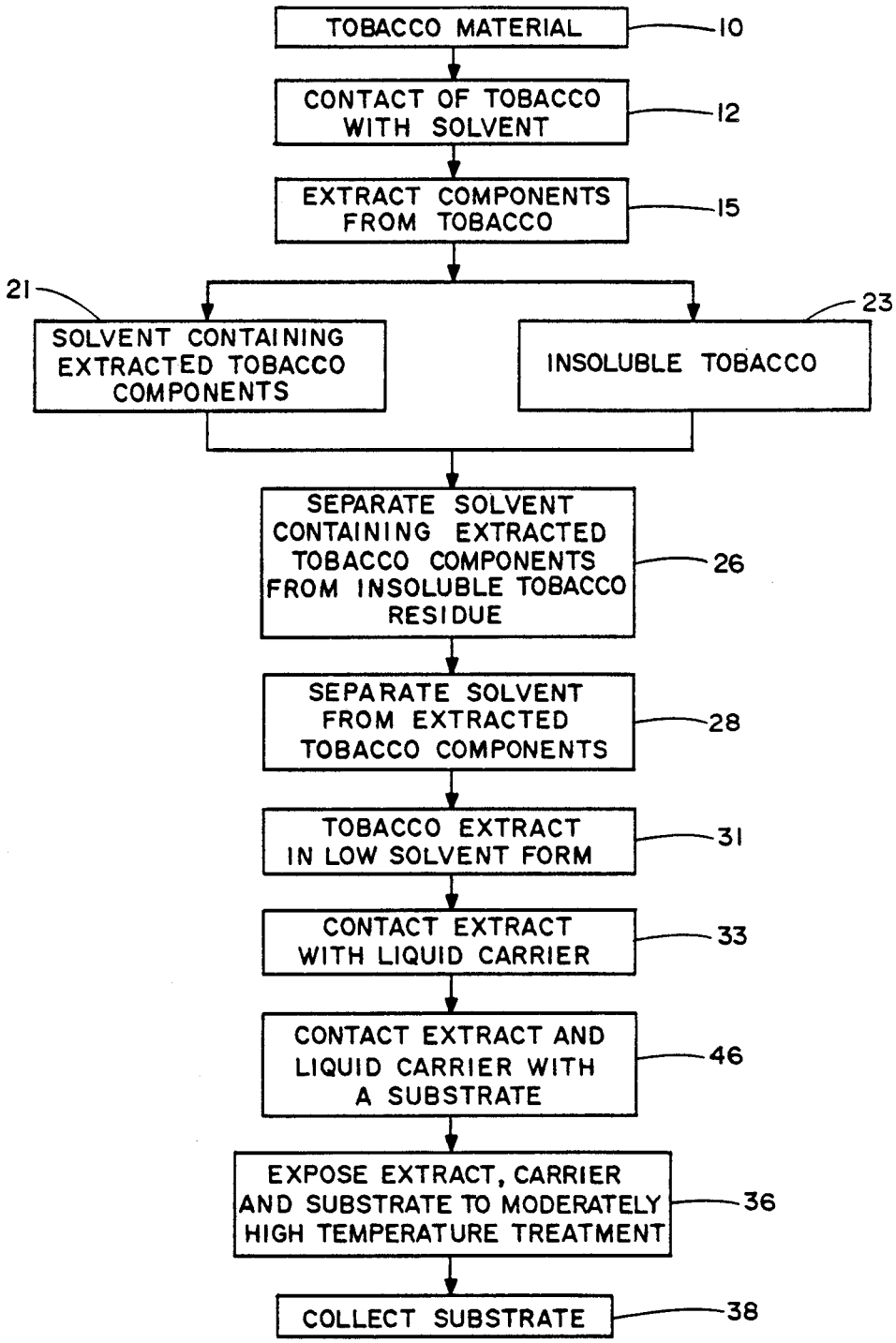

Referring to FIG. 3, tobacco material 10 is extracted using a solvent 12 to provide an isolated extract 31 in low solvent form, and the isolated extract is contacted with a liquid carrier, in a manner as described with reference to FIG. 1. The extract and carrier in turn are contacted with a solid substrate 46, such as alumina beads, carbon fibers, or the like. The extract, carrier and substrate are subjected to moderately high temperature treatment 36 for a period of time sufficient to provide desirable flavor characteristics to the extract. The substrate which carries the liquid material and extract then is collected 38 for later use.

Figure 4:
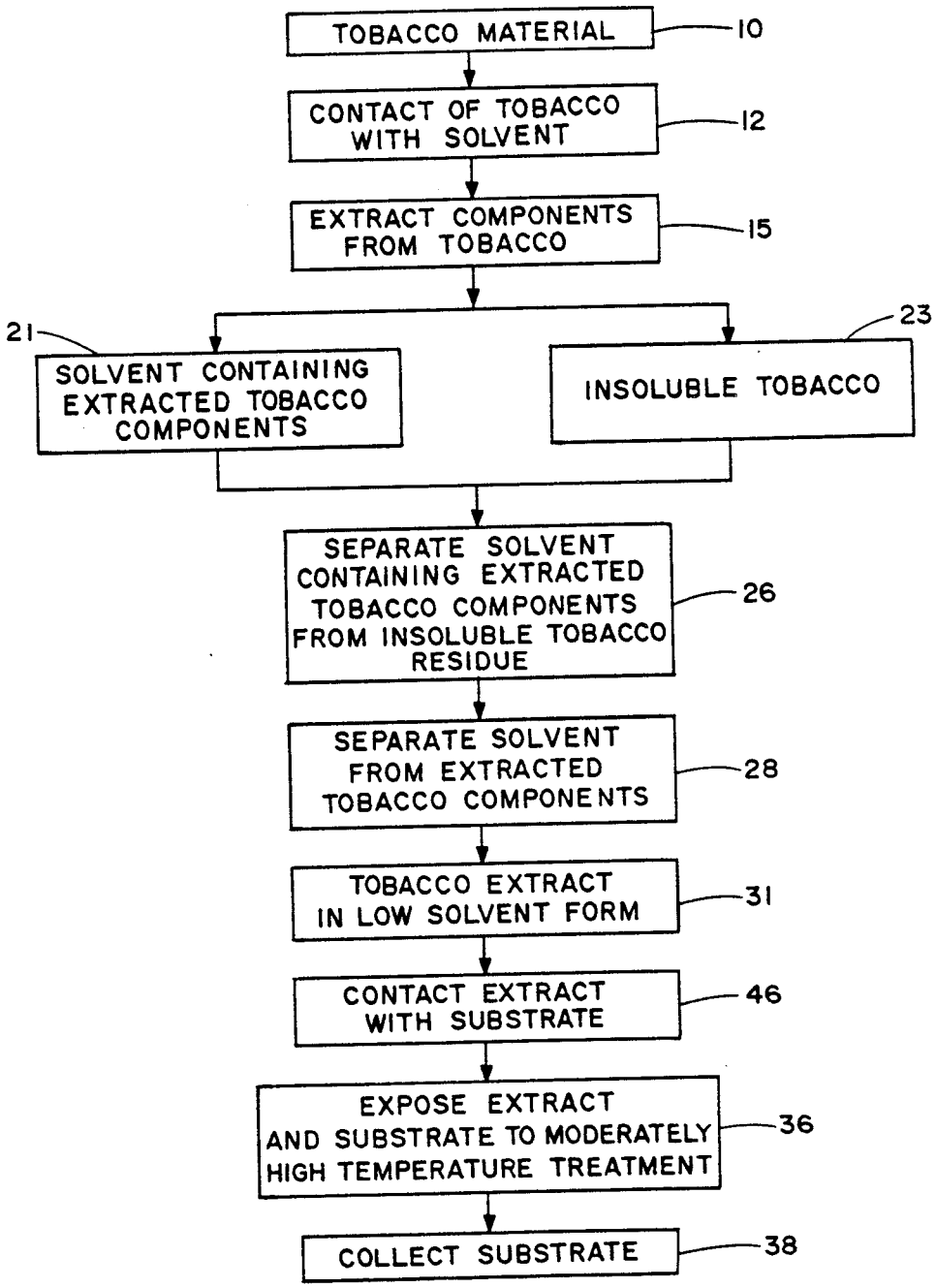

Referring to FIG. 4, tobacco material 10 is extracted using a solvent 12 to provide an isolated extract 31 in low solvent form, in a manner as described with reference to FIG. 1. The tobacco extract then is contacted with a solid substrate 46, such as alumina beads, carbon fibers, or the like. The extract and substrate are subjected to moderately high temperature treatment 36 for a period of time sufficient to provide desirable flavor characteristics to the extract. The substrate which carries the extract then is collected 38 for later use.

Figure 5:
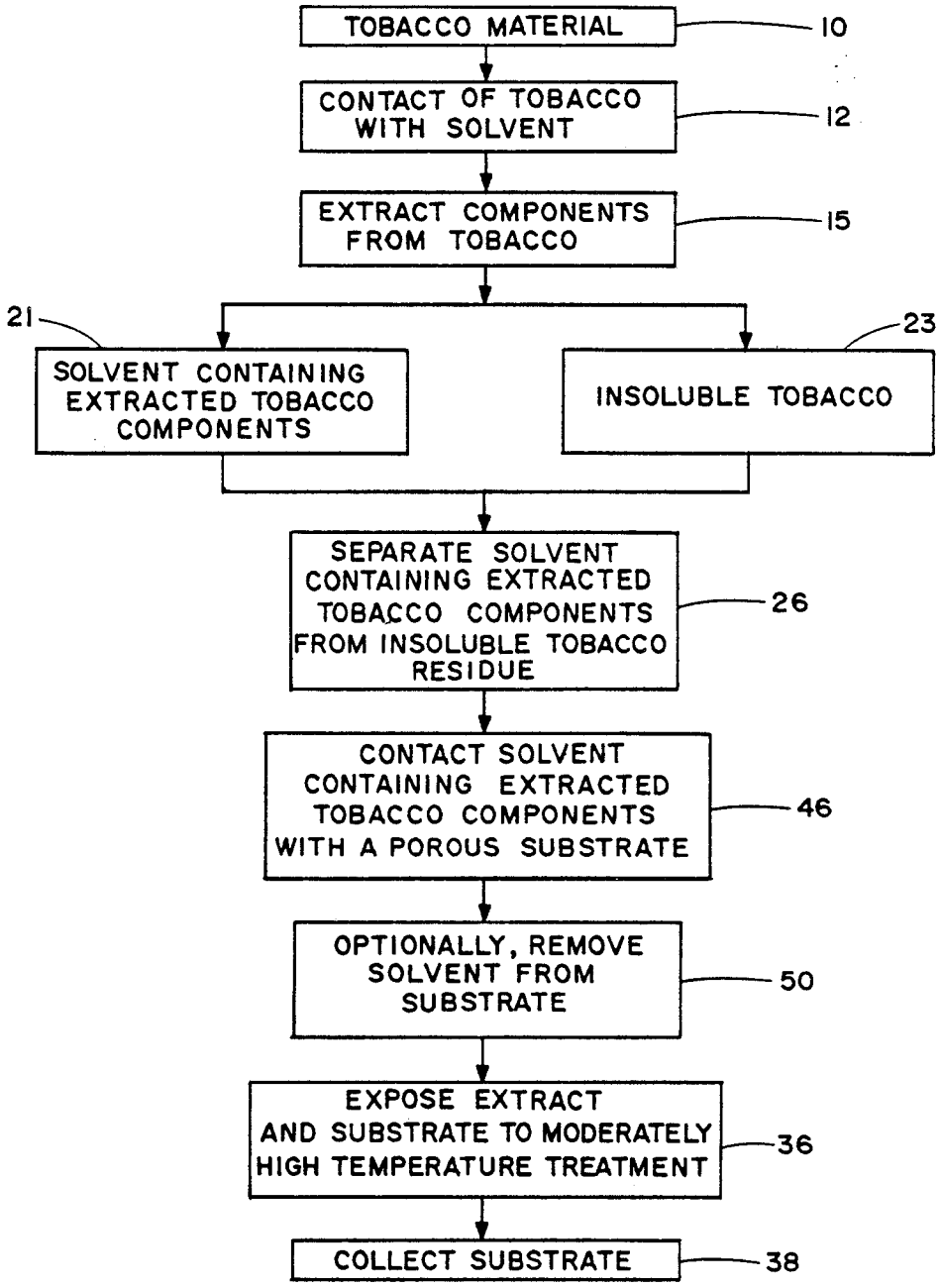

Referring to FIG. 5, tobacco material 10 is extracted using a solvent 12 to provide the solvent containing extracted tobacco components 21, in a manner as described with reference to FIG. 1. The liquid extract then is contacted with a porous, solid substrate 46, such as alumina beads, carbon fibers, or the like. The extract and substrate then can be subjected to moderate heat treatment 50 (e.g., at about 90° C. to about 100° C. in a fluidized dryer) in order to remove a majority of the extraction solvent from the substrate. The extract and carrier then are subjected to moderately high temperature treatment 36 for a period of time sufficient to provide desirable flavor characteristics to the extract. The substrate which carries the extract then is collected 38 for later use.

Figure 6:
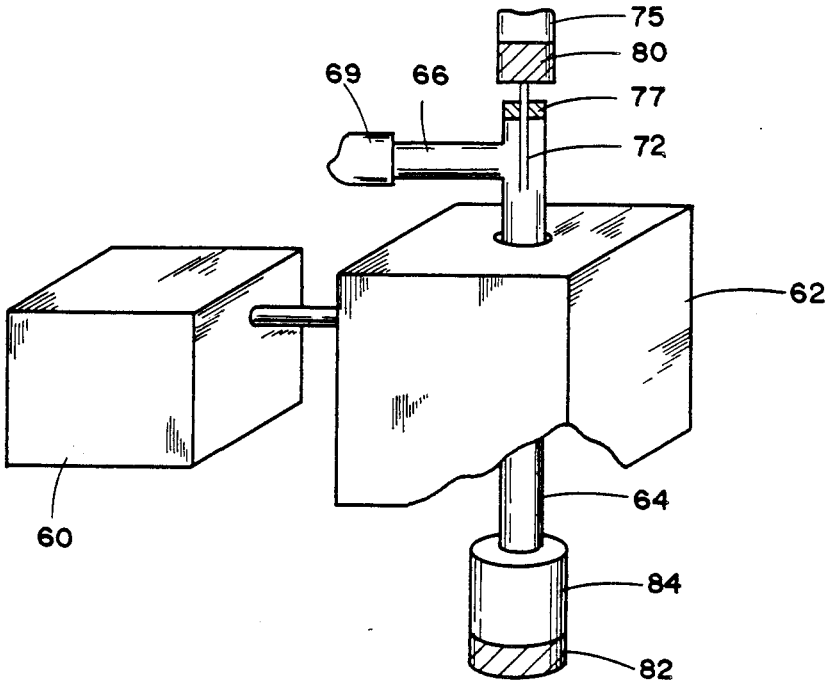
FIG. 6 is a schematic diagram of a representative apparatus for performing the process of this invention.

Referring to FIG. 6, heat control unit 60, such as an electrical rheostat, is connected to heating block 62, such as an aluminum heating block. Heating block 62 is shown as partially cut away. The heating block has a glass tube 64 extending therethrough. An inlet tube 66 supplies an inert gas flow into the top region of tube 64 from a pressurized source of gas (not shown) through supply tube 69 (shown as cut away). Through the top of tube 64 is introduced the needle 72 of syringe 75 (shown as partially cut away) through rubber septum 77. The syringe carries tobacco composition 80 of liquid carrier and tobacco extract. The tobacco composition 80 of tobacco extract and liquid carrier is injected from the syringe 75 into tube 64, and carried by the flow of inert gas through the heating block 62. The resulting tobacco composition 82 which has been subjected to the heat treatment exits tube 64 and is collected in beaker 84, or other collection means.

The tobacco materials useful herein can vary. Examples of suitable tobaccos include flue-cured, Burley, Maryland and Oriental tobaccos, as well as the rare or specialty tobaccos. The tobacco generally has been aged, and can be in the form of laminae and/or stem, or can be in processed form. Tobacco waste materials and processing by-products such as fines, dust, scrap, stems and stalks can be employed. Unaged, uncured mature, or immature tobaccos also can be employed. The aforementioned tobacco materials can be processed separately, or as blends thereof.

A tobacco extract can be provided in a number of ways. In particular, the tobacco material is subjected to extraction conditions with a suitable solvent to extract a sufficient amount of the desired components from the tobacco material. The manner in which the tobacco material is extracted, and the type of solvent employed, can vary. For example, the tobacco material can be subjected to extraction at temperatures and pressures above the critical point of solvent employed. As a result, tobacco extracts can be provided using supercritical fluids such as carbon dioxide, n-hexane, cyclohexane, propane, Freon 11, Freon 123, diethyl ether, methyl acetate, and the like. As another example, the tobacco material can be subjected to an extraction process using liquid solvents such as water, alcohols including methanol and ethanol, ethers including diethyl ether, hydrocarbons including hexane, halocarbons including methylene chloride, Freon 11 and Freon 123, and the like.

Preferably, the tobacco extract is provided by extracting the tobacco material using a solvent having an aqueous character. Such a solvent consists primarily of water, and can be essentially pure water in certain circumstances. For example, a solvent having an aqueous character can be distilled water, tap water, or the like. However, the solvent can include water having substances such as pH buffers, pH adjusters, organic and inorganic salts, surfactants, or the like incorporated therein. The solvent also can be a co-solvent mixture of water and minor amounts of one or more solvents which are miscible therewith.

Methods for extracting components from tobacco materials and isolating tobacco extracts will be apparent to the skilled artisan.

The tobacco extract can have various forms However, if a liquid extraction solvent having a relatively low boiling point is employed, it is desirable to remove a substantial portion of the extraction solvent and to provide the tobacco extract in a substantially solvent free form or in a predominately solid character or form. For example, it is desirable to subject the liquid extract to a spray drying, freeze drying, belt drying, flash drying, or other suitable solvent removal process in order to provide a tobacco extract in a substantially solvent-free form. As such, tobacco extracts normally have the form of a paste, a viscous liquid, a powder, a granular solid, a gel, or the like. Typically, tobacco extracts normally are provided in the form of spray dried extracts, freeze dried extracts, tobacco aroma oils, tobacco essences, or the like.

The extracted tobacco components most preferably are provided in a low solvent form. By the term "low solvent form" is meant that the solvent content including the moisture content of extracted tobacco components is less than about 12 percent, based on the total weight of the extracted tobacco. For example, when the first solvent is essentially pure water, the moisture content of the extracted tobacco components in low solvent form is less than about 12 weight percent. Generally, it is desirable to provide extracted tobacco components having solvent contents less than 10 weight percent; while extracted tobacco components having solvent contents in the range of about 2 weight percent to about 8 weight percent are particularly preferred. Extracted tobacco components in low solvent form have a generally solid form and often can resemble a dry powder, especially when the extract is spray dried.

Convenient methods for providing the extracted tobacco components in low solvent form include spray drying, freeze drying, belt drying, flash drying, or other such methods. It is particularly desirable to concentrate the liquid extract prior to spray drying or freeze drying the extract. Spray drying of the liquid extract is especially preferred. For purposes of this invention, spray drying is a one-step continuous process for removing a liquid from a solution and producing a dried particulate form of the extracted components within the solution by spraying a feed of the solution into a hot drying medium. A representative spray drying process is described in U.S. Pat. No. 3,398,754 to Tughan. For purposes of this invention, freeze drying is an indirect, batch or continuous process for removing the liquid from a solution and producing a dried form of the extracted components by freezing the solution and drying the solution in a frozen state through sublimation under high vacuum. A representative freeze drying process is described in U.S. Pat. No. 3,316,919 to Green. Methods and conditions for providing extracted materials in a low solvent or solid form (e.g., as a powder) will be apparent to the skilled artisan.

The tobacco extract preferably is contacted with a liquid carrier in order to provide an extract and carrier mixture. A liquid carrier, for purposes of this invention, is a normally liquid material in which the tobacco extract can be dissolved and/or suspended. Preferred liquid carriers are thermally stable to at least about 350° C., preferably to at least about 400° C.; and do not react to any significant degree with components of the tobacco extract. It is highly preferred that the liquid carrier have a boiling point below the temperature to which the tobacco composition is exposed according to the process of the present invention. Examples of suitable liquid carriers include propylene carbonate, peanut oil, triacetin, polyhydric alcohols such as glycerine and propylene glycol, and the like, as well as mixtures thereof.

The manner of contacting the tobacco extract with the carrier can vary and is not particularly critical. Typically, the extract and carrier are mixed employing stirring or agitation, and often employing gentle heating. The mixture of extract and carrier normally (i) has a dark brown color, (ii) has the form of a relatively stable suspension of the extract in the carrier, and (iii) is such that at least a portion of the components of the extract is soluble in the carrier.

The amount of carrier relative to the tobacco extract can vary. Typically, the weight of carrier relative to extract is at least about 1:1, preferably at least about 3:1, while the weight of carrier relative to extract normally does not exceed about 20:1.

The tobacco extract or the extract and the liquid carrier can be contacted with a substrate. Preferred substrates are normally solid materials and are thermally stable at those temperatures experienced during the heat treatment steps of this invention. Examples of suitable substrate materials include porous carbons, carbon fibers, carbon yarns, high surface area glass beads, aluminas, clays, and the like. Typical substrates are aluminas available as D-2 Sintered Alpha Alumina from W. R. Grace & Co. and carbon yarns available as Kynol Catalogue No. CFY-020Y-3 from American Kynol, Inc.

The tobacco composition is subjected to moderately high temperature treatment. Typically, high temperature treatment involves exposing the tobacco composition to a temperature in excess of about 150° C., preferably in excess of about 200° C., and more preferably between about 250° C. and about 350° C. However, it is desirable to not subject the tobacco composition to a temperature in excess of about 400° C. in order to avoid the formation of components which are bitter tasting. When the tobacco composition includes a liquid carrier with the tobacco extract, it is desirable to avoid heating the tobacco composition to a temperature excessively high so as to form (i) components which are pasty, or (ii) precipitates in the liquid carrier.

The manner in which the tobacco composition is subjected to the moderately high temperature treatment can vary. Typically, a tobacco composition comprising an extract and liquid carrier is heated as it passes through a heat exchange unit such as the heating block described with reference to FIG. 6, a tube furnace, or the like. Alternatively, the tobacco composition can be heated in a convection oven, or the like, especially when (i) a liquid carrier is not employed with the extract, or (ii) the extract is carried by a solid substrate.

The heat treatment of the tobacco composition preferably is performed under an inert atmosphere. For example, nitrogen and argon gas is employed in order to minimize or prevent the formation of bitter components which result from the oxidation of the tobacco extract.

The amount of time that the tobacco composition is subjected to high temperature treatment can vary depending upon factors such as the weight of the tobacco composition which is heated and temperature to which the tobacco composition is heated. Normally, the time period is sufficient to heat 1 g of tobacco composition at the desired temperature for a period of at least about 0.5 minute, preferably about 1 to about 2 minutes. Tobacco compositions having a low mass can be heated at the desired temperature in a relatively short period of time. However, it is desirable to control the time/temperature profile of tobacco compositions subjected to heat treatment so that each tobacco composition is not subjected to a particularly high temperature for a lengthy period of time.

It is convenient to refer to a "temperature exposure index" with regards to the amount of heat which is applied to a particular tobacco composition over a particular period of time. For a tobacco composition having a mass M which is exposed to a temperature T for a period of time P, the temperature exposure index H according to this invention is defined by:

$$H = \frac{T(^\circ\text{C.}) \times P(\text{min.})}{M(\text{g})}$$

Typical temperature exposure index values for the process of this invention range from about 200 to about 600, preferably from about 250 to about 500.

After the tobacco composition has been subjected to high temperature treatment for the controlled period of time, the tobacco composition is collected. The tobacco composition is provided in various forms for use in the manufacture of smoking articles. For example, a heat-treated tobacco composition in the form of a tobacco extract can be contacted with a liquid carrier such as glycerine, propylene glycol, ethanol, water, or the like, and employed as a form of tobacco in smoking article manufacture. Alternatively, a heat-treated tobacco composition including a tobacco extract in a liquid carrier can be employed in smoking article manufacture, with or without further dilution of the tobacco composition with a suitable liquid such as glycerine, or the like. Forms of heat treated tobacco composition can be applied directly to smokable materials. For example, tobacco cut filler can be blended with about 0.05 to about 5 weight percent of the heat-treated tobacco extract, based on the weight of the smokable material Furthermore, the heat-treated tobacco composition having the form of substrate, tobacco extract and optional liquid material can be employed in the manufacture of those smoking articles described in U.S. Pat. Nos. 4,708,151 to Shelar; 4,771,795 to White et al.; 4,714,082 to Banerjee et al.; 4,756,318 to Clearman et al.; and 4,793,365 to Sensabaugh et al.; as well as European Patent Publication Nos. 212,234 and 277,519.

The following examples are provided in order to further illustrate various embodiments of the invention but should not be construed as limiting the scope thereof. Unless otherwise noted, all parts and percentages are by weight.

EXAMPLE 1

An aluminum metal heating block shown generally in FIG. 6 has a length of 70 mm, a depth of 50 mm and a width of 50 mm, and has a 7 mm diameter passageway extending through the center of the block along the length thereof. A glass tube having an outer diameter of about 7 mm, an inner diameter of about 5 mm and length of about 100 mm is inserted into the passageway within the block. To one end of the glass tube is attached a "T" tube equipped with a syringe. The heating block is heated to and maintained at 350° C.

An aged flue-cured tobacco in cut filler form is extracted in a stainless steel tank at a concentration of about 1 pound of tobacco per gallon of water. The extraction is conducted at ambient temperature (e.g., about 20° C.) while mechanically agitating the mixture over about a 1 hour period. The admixture is centrifuged to remove essentially all suspended solids. The aqueous extract is concentrated in a thin film evaporator to a concentration of about 30 percent dissolved solids. Thin film evaporation conditions are such that water is evaporated from the extract while loss of flavorful tobacco volatiles is minimized. The concentrated aqueous extract then is spray dried by continuously pumping the aqueous solution to an Anhydro Size No. 1 spray dryer. The dried powder is collected at the outlet of the dryer. The inlet temperature of the spray dryer is about 215° C., and the outlet temperature is about 82° C. The spray dried material is a brown, powdery material, and has a moisture content of about 5 percent to about 6 percent.

The spray dried extract is mixed with a liquid carrier. In particular, 5 g of the extract is mixed with 45 g of glycerine thereby forming a stable brown suspension.

The extract and carrier mixture is dripped into the hot tube from the syringe at a 1.35 g/min. rate, while nitrogen at 10 ml/sec. rate is passed through the tube. As such, a 10 g mixture of the extract and carrier experiences a high temperature treatment at 350° C. for 7.38 minutes. As such, the mixture is subjected to a temperature exposure index of about 258 min.°C./g.

The heat-treated extract and carrier exits the heating block through the glass tube and is collected in a beaker. The mixture is a viscous fluid having a dark brown color. The mixture exhibits a tobacco aroma.

The heat-treated tobacco extract and carrier are employed as a tobacco component and aerosol forming material for a cigarette which heats, but does not burn tobacco. The cigarette employs a short, carbonaceous fuel element, a 38 mm long aluminum capsule filled with alpha alumina beads in a heat exchange relationship with the fuel element, a roll of volume expanded Burley tobacco roll surrounding the capsule, a pleated section of tobacco paper, and a low efficiency polypropylene web filter. Such a cigarette is described in *Chemical and Biological Studies on New Cigarette Prototypes that Heat Instead of Burn Tobacco,* R. J. Reynolds Tobacco Co., (1988). The alpha alumina beads are available as D-2 Sintered Alpha Alumina from W. R. Grace & Co.

To the alpha alumina beads of the cigarette is applied the heat-treated tobacco extract and carrier in an amount of 1 part extract and carrier to 4 parts beads. Then, 300 mg of the extract and carrier treated alpha alumina beads are incorporated into the aluminum capsule of the cigarette.

The resulting cigarette is smoked, and provides a smooth character without green notes.

EXAMPLE 2

Aged flue-cured tobacco is provided in a spray dried form, as described in Example 1. The spray dried extract is mixed with glycerine in the amount of 15 parts extract to 85 parts glycerine.

The mixture of glycerine and spray dried extract is subjected to heat treatment in the manner described in Example 1.

The heat-treated tobacco extract and carrier are incorporated into a cigarette of the type described in Example 1, in a manner described in Example 1. The cigarette is smoked and provides a mild tobacco flavor.

EXAMPLE 3

A 5 g tobacco composition comprising a mixture of 15 parts spray dried aqueous extract of aged flue-cured tobacco, 15 parts spray dried aqueous extract of aged Burley tobacco, and 70 parts glycerine is charged into a beaker and covered with a watchglass. The beaker containing the 5 g mixture is placed in a convection oven preheated to 250° C. The mixture is heated for 10 minutes. As such, the tobacco composition is subjected to a temperature exposure index of about 500 min.°C./g. The weight loss of the mixture during heat treatment is 0.16 g.

The heat-treated extract and carrier are incorporated into a cigarette of the type described in Example 1, except that 1 part of the heat treated tobacco composition is applied to 3 parts of the alpha alumina substrate. The substrate having the heat-treated tobacco composition applied is aged for 5 days under ambient conditions. Then, 300 mg of the substrate carrying tobacco composition is incorporated into the aluminum capsule of the cigarette, and the cigarette is smoked.

EXAMPLE 4

A 1 g tobacco composition comprising a mixture of 1 part spray dried aqueous extract of aged flue-cured tobacco, 1 part spray dried aqueous extract of aged Burley tobacco and 18 parts glycerine is charged into a sealed end glass tube 10 cm long having a 7 mm outer diameter and a 5 mm inner diameter. The tube is inserted into the passageway of the heating block described in Example 1. The 1 g tobacco composition is heated at 350° C. for 40 seconds. As such, the tobacco composition is subjected to a temperature exposure index of about 233 min.°C./g.

EXAMPLE 5

Into a flask is charged 1 part spray dried aqueous extract of aged flue-cured tobacco and 8 parts absolute ethanol. The flask is sealed, placed in an ultrasonic bath (temperature about 20° C.), and subjected to ultrasonic treatment for about 15 minutes. The agitated mixture is filtered through No. 1 qualitative filter paper using a Buchner funnel and a vacuum flask. The flask which contained the spray dried extract and the ethanol, and the spent spray dried filter cake is washed with ethanol. The filtrate is collected from the vacuum flask and transferred to a round bottom flask. The filtrate is subjected to vacuum treatment (at about 22 inch Hg vacuum and in a water bath held at about 60°) using a Brinkman Rotovap laboratory rotary evaporator in order to remove essentially all of the ethanol and isolate the residue. The residue or essence is a homogeneous, viscous liquid having a dark brown color, and displaying a tobacco aroma.

A 3 g sample of the essence is mixed with 9 g of glycerine, and 0.5 ml of the resulting mixture is subjected to heat treatment in a manner described in Example 1.

EXAMPLE 6

A 0.5 g mixture of 12.5 parts spray dried aqueous extract of aged flue-cured tobacco, 12.5 parts spray dried aqueous extract of aged Burley tobacco and 75 parts glycerine is coated onto 1.5 g of alumina beads available as D-2 Sintered Alpha Alumina from W. R. Grace & Co. The resulting 2 g mixture of extract, liquid and substrate is heated for 2 minutes in a preheated convection oven set at 250° C. As such, the tobacco composition is subjected to a temperature exposure index of 250 min.°C./g.

The heated mixture is cooled to room temperature, and 300 mg of the mixture is incorporated into the aluminum capsule of the cigarette described in Example 1. The resulting cigarette is smoked and provides a tobacco smoke flavor.

EXAMPLE 7

A 5 g sample of a mixture of 50 parts spray dried aqueous extract of aged flue-cured tobacco and 50 parts spray dried aqueous extract of aged Burley tobacco is charged into a beaker with a glass cover and heated in a preheated convection oven set at 250° C. The 5 g mixture is exposed to the 250° C. temperature for 5 minutes. As such, the tobacco composition is subjected to a temperature exposure index of 250 min.°C./g. The mixture is baked to a dark, hard cake.

The cake is cooled and broken into small pieces The pieces are contacted with glycerine such that a portion of the heat treated extract is taken up by the glycerine. Then, 1.3 g of the glycerine and extract mixture is applied to 4.3 g of alumina beads, and 300 mg of the resulting beads are incorporated into the aluminum capsule of the cigarette described in Example 1.

EXAMPLE 8

The steps described in Example 7 are repeated, except that the 5 g sample of spray dried tobacco extract is exposed to the 250° C. temperature for 10 minutes, rather than 5 minutes. As such, the tobacco composition is subjected to a temperature exposure index of about 500 min.°C./g.

EXAMPLE 9

A 1 g mixture of 50 parts spray dried aqueous extract of aged flue-cured tobacco and 50 parts spray dried aqueous extract of aged Burley tobacco is mixed with 1.3 g of glycerine. The resulting 2.3 g mixture is charged into a beaker with a glass cover and heated in a preheated convection oven set at 250° C. The 2.3 g sample is exposed to the 250° C. temperature for 2 minutes. As such, the tobacco composition is subjected to a temperature exposure index of about 217 min.°C./g.

The 2.3 g mixture is diluted with 2.3 g of glycerine, and 1 g of the diluted mixture is applied to 3 g of alumina beads. Then, 300 mg of the resulting beads are incorporated into the aluminum capsule of the cigarette described in Example 1.

The cigarette is smoked, and provides a tobacco smoke taste with good mouthfeel.

What is claimed is:

1. A process for providing flavorful tobacco substances, the process comprising:

(a) providing a tobacco composition including a tobacco extract carried by a substrate, and (b) subjecting the tobacco composition to heat treatment by exposure to a temperature above about 150° C. and within a temperature exposure index of about 200 to about 600 min.°C./g.

2. The process of claim 1 wherein the substrate further carries a liquid carrier for the tobacco extract; and the extract, liquid carrier and substrate are subjected to heat treatment within a temperature exposure index of about 200 to about 600 min.°C./g.

3. The process of claim 2 wherein the liquid carrier includes a polyhydric alcohol.

4. The process of claim 1 or 2 whereby the substrate is alumina.

5. A process for providing flavorful tobacco substances, the process comprising:

(a) providing flavorful composition including a tobacco extract within a liquid carrier, and (b) subjecting the tobacco composition to heat treatment by exposure to a temperature above about 150° C. and within a temperature exposure index of about 200 to about 600 min.°C./g.

6. The process of claim 5 whereby the liquid carrier includes a polyhydric alcohol.

7. A process for providing flavorful tobacco substances, the process comprising:

(a) providing a tobacco composition including a tobacco extract in a low solvent form, and (b) subjecting the tobacco composition to heat treatment by exposure to a temperature above about 150° C. and within a temperature exposure index of about 200 to about 600 min.°C./g.

8. The process of claim 1, 2, 5, or 6 whereby the tobacco extract is a spray dried aqueous tobacco extract.

9. The process of claim 1, 2, 5 or 6 whereby the tobacco composition is subjected to heat treatment by exposure to a temperature above about 200° C.

10. The process of claim 1, 2, 5 or 6 whereby the tobacco composition is subjected to heat treatment by exposure to a temperature between about 250° C. and about 350° C.

11. The process of claim 1, 2, 5 or 6 whereby the tobacco composition is subjected to heat treatment by exposure to a temperature less than about 400° C.

12. The process of claim 1, 2, 5 or 6 whereby the tobacco composition is subjected to a heat treatment within a temperature exposure index of about 250 to about 500 min.°C./g.

13. The process of claim 2, 3, 5 or 6 whereby the weight of carrier relative to extract is at least about 1:1.

14. The process of claim 2, 3, 5 or 6 whereby the weight of carrier relative to extract is at least about 3:1.

15. The process of claim 5 or 6 whereby the tobacco composition is subjected to heat treatment under an inert atmosphere.

16. The process of claim 2, 3, 4, 5 or 6 whereby the extract has a solvent content of about 2 to about 8 weight percent.

17. The process of claim 3, 4, 5 or 6 whereby the liquid carrier is thermally stable to at least about 350° C.

18. The process of claim 16 whereby the tobacco extract is provided by extracting a tobacco material using a solvent having an aqueous character.

19. A process for providing flavorful tobacco substances, the process comprising:

(a) providing a tobacco composition including a tobacco extract, and (b) subjecting the tobacco composition to heat treatment under an inert atmosphere by exposure to a temperature above about 150° C. and within a temperature exposure index of about 200 to about 600 min.°C./g.

20. A process for providing flavorful tobacco substances, the process comprising:

(a) providing a tobacco composition including a tobacco extract having a solvent content of about 2 to about 8 weight percent, and (b) subjecting the tobacco composition to heat treatment by exposure to a temperature above about 150° C. and within a temperature exposure index of about 200 to about 600 min.°C./g.

* * * * *